United States Patent [19]

Shultz et al.

[11] Patent Number: 4,480,827

[45] Date of Patent: Nov. 6, 1984

[54] PIVOTAL FEED HEAD FOR PRINTING APPARATUS

[75] Inventors: Richard E. Shultz, Maitland; William F. Voecks, Jr., Winter Park, both of Fla.

[73] Assignee: Burroughs Corporation, Detroit, Mich.

[21] Appl. No.: 481,036

[22] Filed: Mar. 31, 1983

Related U.S. Application Data

[63] Continuation-in-part of Ser. No. 445,566, Nov. 23, 1982, , which is a continuation of Ser. No. 240,898, Mar. 5, 1981, abandoned.

[51] Int. Cl.[3] ..... B65H 7/08

[52] U.S. Cl. ..... 271/111; 271/114; 271/125; 271/155; 271/157; 271/259; 271/117; 271/126

[58] Field of Search ..... 271/110, 111, 116, 117, 271/114, 121, 122, 124, 125, 154, 155, 258, 259, 157, 10, 126

[56] References Cited

U.S. PATENT DOCUMENTS

| | | | |
|---|---|---|---|
| 2,036,919 | 4/1936 | Calmes | 271/125 |
| 2,992,820 | 7/1961 | Tarbuck | 271/153 X |
| 3,047,290 | 7/1962 | Thomsen | 271/116 |
| 3,062,534 | 11/1962 | Benson | 271/114 |
| 3,114,902 | 12/1963 | Tanguy | 271/259 X |
| 3,378,254 | 4/1968 | Eichorn | 271/155 |
| 4,171,129 | 10/1979 | Daley | 271/126 X |

OTHER PUBLICATIONS

IBM Technical Disclosure Bulletin, vol. 14, No. 8, Jan. 1972, pp. 2396–2397, "Stack Paper Feed", J. A. Craft et al.

*Primary Examiner*—Richard A. Schacher

*Attorney, Agent, or Firm*—Carl Fissell, Jr.; Edmund M. Chung; Kevin R. Peterson

[57] ABSTRACT

A pivotal feed head for feeding non-rigid paper sheets individually from a feed hopper to a photo-optical utilization station at high speed without interruption, overlap or collision between sheets including oppositely disposed members for applying a normal force between an enlarged resilient tired feed wheel adapted for unidirectional rotation and a conjointly movable, engageable retard roller. The feed head is mounted for pivotal movement about an outboard drive member. A frictional brake for the retard roller is adjustable to provide a preset load at the nip between the feed wheel and the retard roller while a solenoid-actuated one-way clutch operably engages the feed wheel mounting shaft for incremental signal controlled paper feed. A vertical, signal-controlled latching member locks the feed head in a vertical pivoted position at the end of the vertical upward movement of the paper stack platform as the paper is fed into the nip between the feed wheel and the retard roller.

5 Claims, 10 Drawing Figures

PIVOTAL FEED HEAD FOR PRINTING APPARATUS

This is a continuation-in-part of application U.S. Ser. No. 445,566, (pending) filed Nov. 23, 1982 which in turn is a continuation of application U.S. Ser. No. 240,898, filed Mar. 5, 1981, now abandoned.

BACKGROUND OF THE INVENTION

1. Field of the Invention

The invention relates generally to apparatus for feeding or moving individual paper sheets and more specifically to a novel single wheel pivoted paper feed head for feeding single sheets from a stack of sheets one at a time to a recording and/or copying station.

2. Description of the Prior Art

Feeding and transporting flimsy sheet items such as paper and the like involves numerous problems not the least of which included multiple feed, overlapping feed and collision between sheets resulting in crumbling of the paper, jamming and tearing which often results in complete jamming of the machine.

A common means of attempting to avoid or overcome these problems include counter rotating rollers arranged in the path of movement of the paper and disposed in surface contact so as to "strip" the lower sheet from the upper sheet permitting the upper sheet to pass to its intended destination.

Another structural arrangement utilizes counter-rotating belts often in the form of an irregular triangle disposed adjacent to the feed drive wheels and also operable to strip the lower sheet from the upper sheet.

None of these prior systems is completely "fail safe" in that each is subject to wear and alignment problems and each requires a relatively high degree of mechanical tolerance and accuracy. Belts tend to slip and produce irregular wear while both wheels and belts or pulleys are noisy and expensive to maintain and replace.

SUMMARY OF THE INVENTION

It is an important object therefore of the present invention to provide a feeding mechanism or apparatus for feeding single sheet items at relatively high speed and which is movable into and out of the path of movement of the item loading/stacking device with which the feeding unit may be operably associated.

Another important object of the invention is the provision of a signal actuated feed head for feeding single sheet items from a stack of items one at a time without time overlap, collision, or duplication.

Still another object of the invention is the provision of a pivoted feed head including means enabling the feed head to be arcuately pivoted or rocked out of the path of movement of the reloading apparatus from which the paper items are to be fed and to be latched into an inoperative position.

These and other objects and advantages are attained by the present invention wherein there is provided a single roller feed apparatus for feeding a single sheet item on demand, comprising an enlarged, cantilever supported, resiliently tired, centerly disposed feed wheel rotatably, operably associated with a smaller horizontally disposed elongated retard roller. A continually operable drive means operably interconnects a solenoid actuated one-way clutch with the feed wheel effective to rotate the feed wheel incrementally on demand so as to feed a sheet at a time from a stack of sheets to a utilization device such for example as a xerographic type printing/copying station. Means is provided for adjusting retard forces as well as the applied normal force between the feed wheel and the retard roller so as to assure single item feed at all times without overlap, duplication or collision between sheets. The feed wheel is provided with means preventing rotation in a direction opposite to that in which the sheets are normally being fed. The feed head as a unitary assembly is arcuately rotatable about a central pivot point to bring the head upwardly into a latched position out of the way of operably associated sheet item auto-loading apparatus, and includes signal control means for automatically unlatching the feed head so as to reposition the feed head into a feeding position relative to the reloaded stack of sheet items.

BRIEF DESCRIPTION OF THE DRAWINGS

FIGS. 4-A and 4-B are partial top plan views of the apparatus of FIGS. 1 and 2;

DETAILED DESCRIPTION OF THE PREFERRED EMBODIMENT OF THE PRESENT INVENTION

Figure 1:
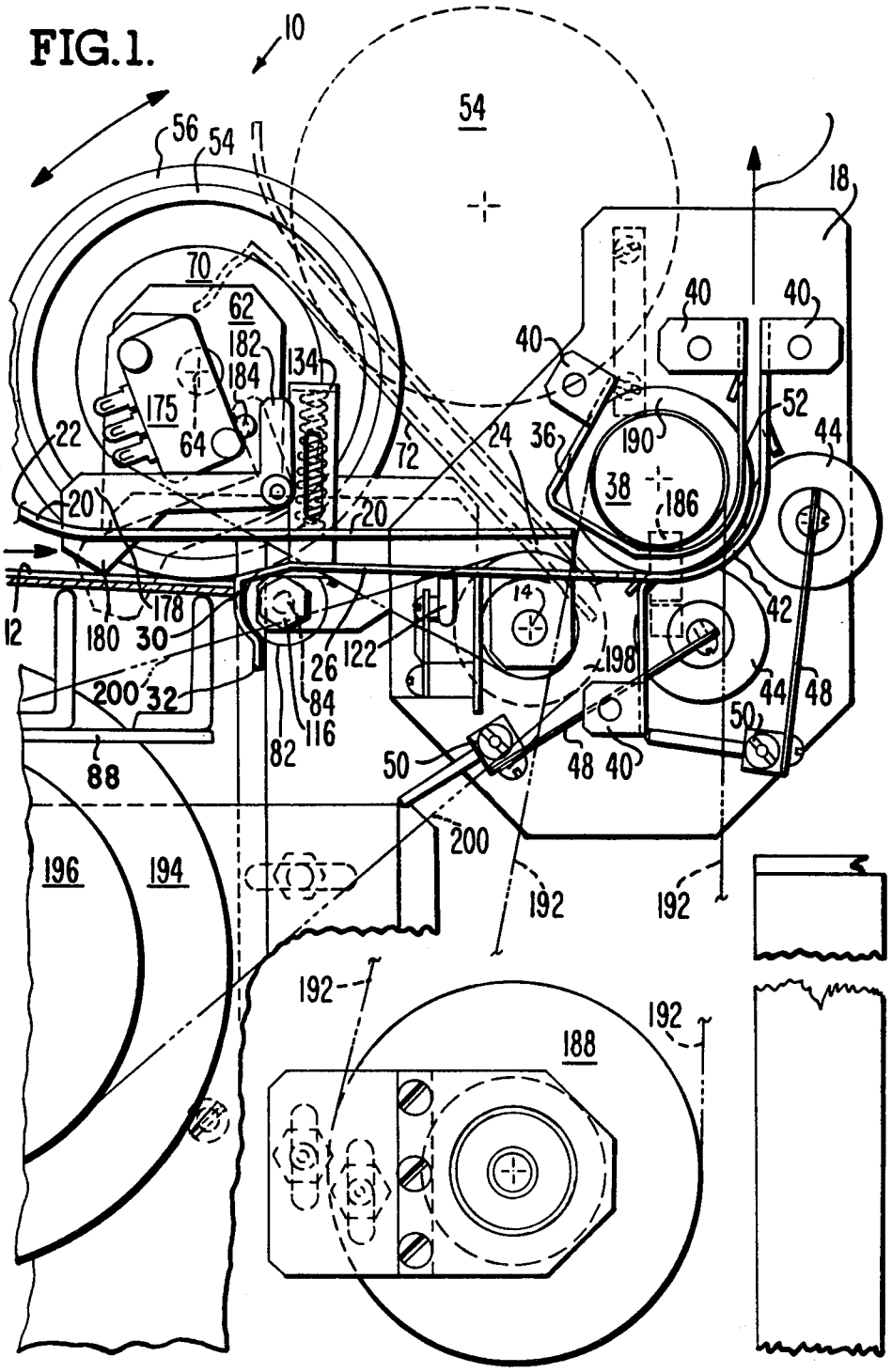
FIG. 1 is a vertical side elevational view of the apparatus embodying the present invention.

As seen first in FIG. 1 of the drawings, the cantilever pivoted feed head 10 of the present invention is or may be employed with a sheet item loader/reloader apparatus (not shown) in a manner to permit an operator to load and reload sheet items 12 "on the fly", i.e., without stopping the printing-copying-feeding apparatus. The loader/reloader apparatus is illustrated, described and claimed in copending U.S. Ser. No. 302,953, entitled "Automatic Reloader-Elevator For Cut Sheet Printing Apparatus", filed Sept. 16, 1981, in the names of Richard E. Shultz and William F. Voecks Jr., assigned to the same assignee as the present invention. It is noted that only these portions of the apparatus directly having to do with the invention per se are illustrated to avoid confusion of the drawings by a conglomeration of lines which otherwise would have been necessary.

For the reasons above stated, the feed head 10 is pivoted about supporting and locating pivot shaft 14 and thus arcuately movable from the full line position (FIG. 1) to the dotted line position, as will be described later on herein. The head structure is supported between two oppositely disposed left and right side plates, 16 and 18, respectively, as seen most clearly in FIG. 2. The pivot shaft 14 is mounted between side plates 16 and 18, as by bolts, as shown. The side plates are fastened to the vertical side frame of the base apparatus (not shown).

Figure 2:
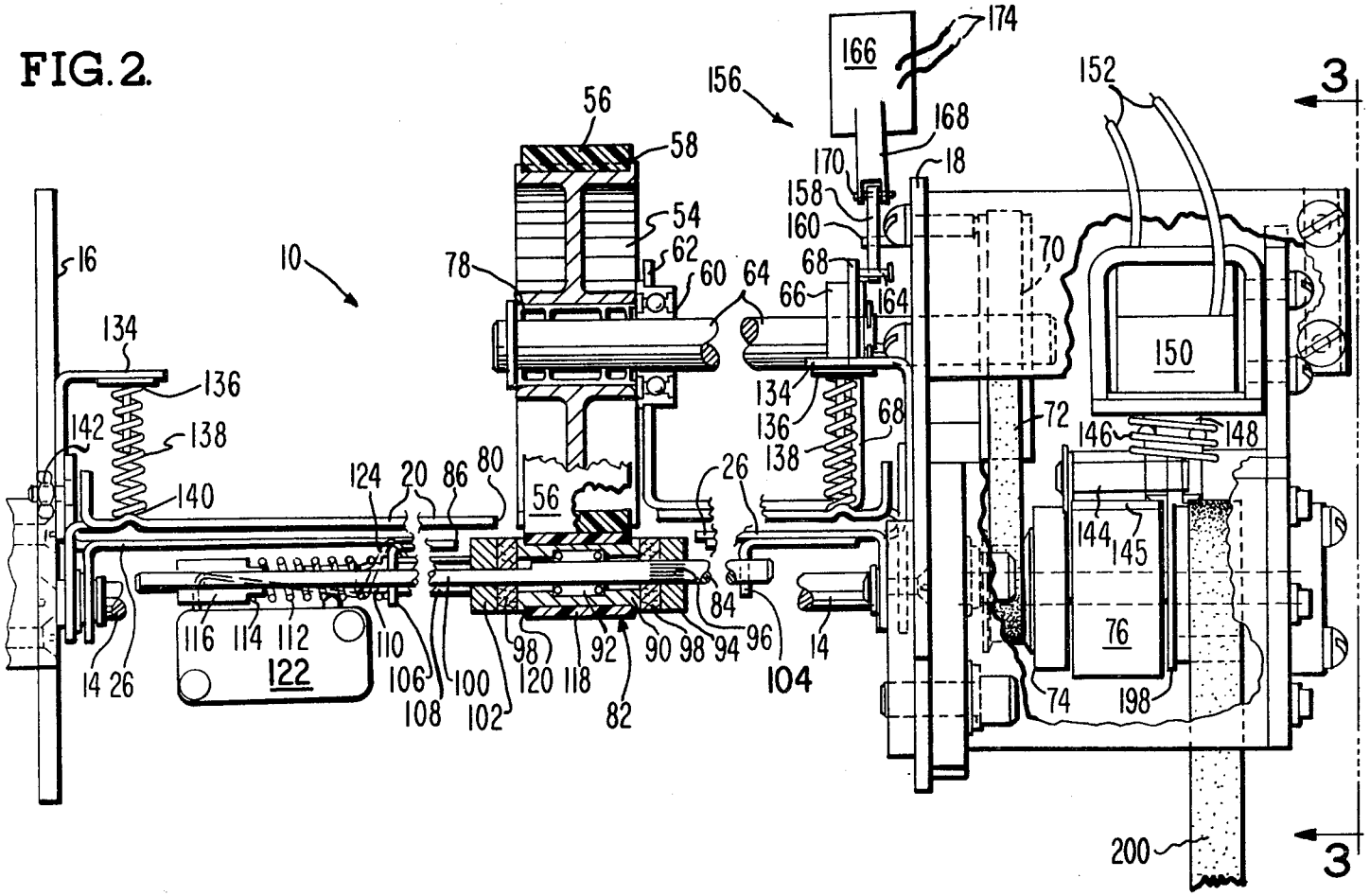
FIG. 2 is a front view of the single roller feed head apparatus of FIG. 1.

An upper sheet metal item deflector guide 20 having a slight curvature 22 at its forward or leading edge to deflect paper items 12 downwardly is mounted at its inboard opposite ends to a bracket 24 on pivot shaft 14 for arcuate movement thereabout. A lower sheet metal item deflector guide 26 secured by oppositely disposed, depending tangs or tabs, as seen in FIG. 2, for rockable movement about fixed cross shaft 14 has its forward-leading end slanted outwardly and downwardly as at 30 terminating in a vertical downwardly turned end 32. Together the parallel guides 20 and 26 form a sheet item throat into and through which the items 12 are, or may be, moved as will be described shortly herein. Both members 20 and 26 are pivotally, rockably movable about pivot shaft 14 as the assembly 10 is arcuately raised and lowered. Note the break in the rightward portion of members 26 beneath the item turnaround, as described hereinafter.

At the inboard end of the item feeder head the items 12 are obliged to make a 90 degree right angle turn, vertically, upwardly so as to place the items in the proper pathway for printing and/or copying. An upper curve sheet metal guide member 36 is disposed in a tightly curved formation surrounding a downstream drive roller 38 and is attached at opposite ends by upper and lower brackets 40 to opposite side wall members 16 and 18. A lower curved sheet metal item guide 42 is disposed in parallel with guide 36 and is curved similarly thereto forming an item guide throat therebetween. Brackets 40 at opposite ends of lower guides 42 secure the member to the side walls 16 and 18.

Figure 7:
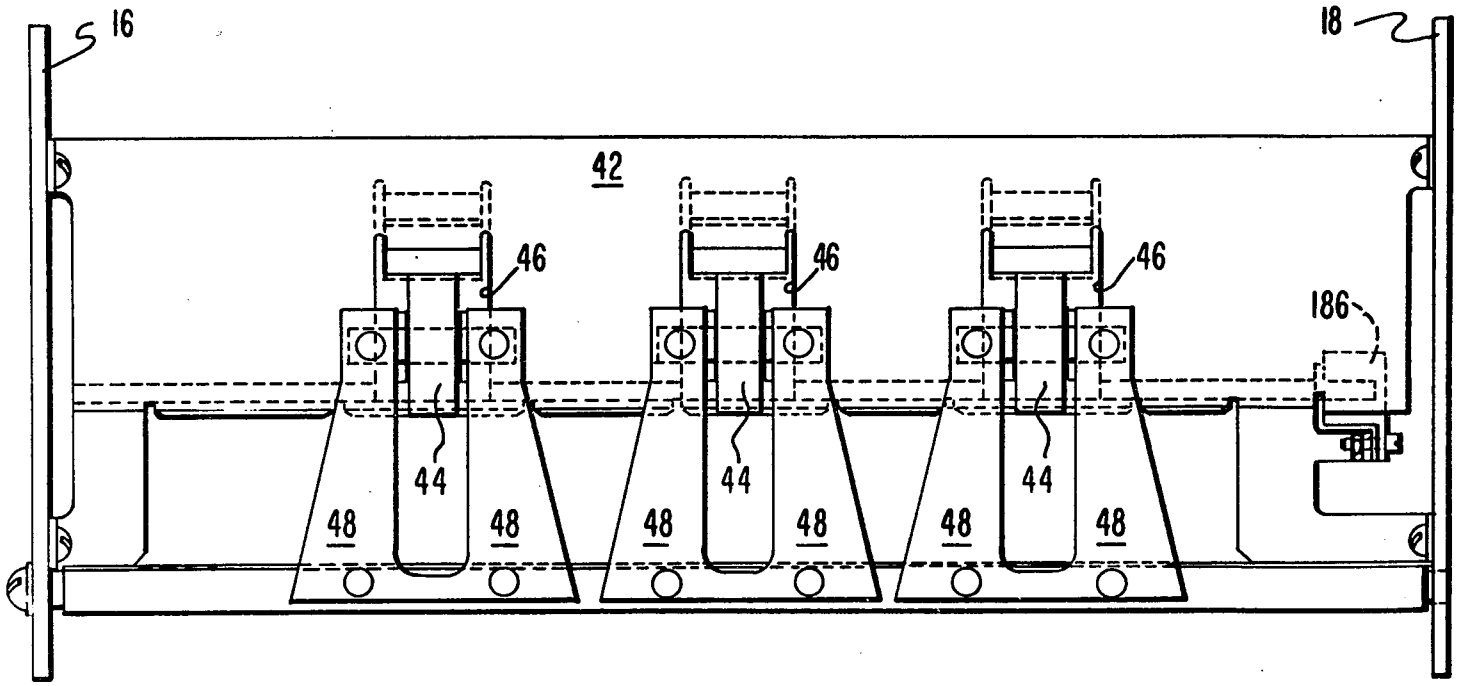
FIG. 7 is a view of the idle rollers of FIGS. 4-A and 4-B.

Backup idler rollers 44 which are angularly offset relative to drive roller 38 are biased into engagement with drive roller 38 through respective apertures 46 in sheet metal guide 42 (FIG. 7) by means of spring flexure members 48 adjustably positionable by means of member 50. Drive wheel 38 is likewise arranged so that the periphery projects slightly through and beyond aperture 52 in guide 36 so as to contact backup rollers 44.

As seen more clearly in FIG. 2. The present invention utilizes a single relatively large, sheet item feed wheel-paper feed drive roller 54 carrying a polyurethane tire 56, the latter being retained in a shallow groove or channel 58 in wheel 54.

A bearing member 60 press fitted into a vertical bracket 62 supports the outboard cantilevered end of drive shaft 64 to which feed wheel 54 is secured as by a rollpin, etc. The inboard end of shaft 64 is rotatably supported through bearing member 66 in vertical bracket 68. The rightward (inboard) end of shaft 64 carries a drive pulley 70. A drive belt 72 connects pulley 70 to pulley 74 of one revolution clutch 76 for purposes to be explained later on herein. Feed wheel 54 is rotatable on a one-way bearing 78 effective to prevent reverse movement of this member.

In its operative item feeding position (full line FIG. 1) the periphery of feed wheel 54 is adapted to extend downwardly into and through an opening 80 in upper item guide 20 so as to be in surface contact with an item retard roller 82 rotatably mounted on cross shaft 84. The latter extending from side to side intermediate the outer wall structures 16 and 18, as will be described presently. The periphery of retard roller 82 projects upwardly into and through a slotted opening 86 in lower item guide 26 (FIG. 2). The juncture of feed wheel 54 and the retard roller 82 forms an item entering "nip" FIG. 1 into which the items 12 are fed from vertically movable item feed tray 88. Although not shown nor descibed in detail in this application, since it is not claimed per se as part of the present invention, the item feed tray 88 (FIG. 1) includes a plurality of upstanding parallel, spaced apart, projections or lands providing a platform or support for receiving the horizontally disposed stack of paper items.

As shown in FIG. 2 the retard roller 82 is a composite structure comprising a rigid, cylindrical, steel hub 90 rotatably disposed on the (rightward) circular cross section portion of cross shaft 84 by means of a needle bearing 92. An inboard shoulder member 94 is press fitted to the splined portion 96 shaft 84. Brake material 98 is disposed at opposite ends of hub 90. Shaft 84 is provided with an elongated flat portion 100 (leftward), as shown. An outboard shoulder or bushing 102 having a complimentary flat (not shown) is non-rotatably disposed on shaft 84 at the left end of hub 90. Shaft 84 is supported at opposite ends by depending brackets 104 and 106 and restrained against turning movement by a slot-like opening in bracket 106 conforming to the flat portion of the leftward end of shaft 84. An elongated, hollow, cylindrical spacer member 108 is disposed between member 102 and bracket 106. Spring retainer 110 seated against the bracket 106 supports a compression spring 112 surrounding the left end of shaft 84. The opposite end of spring 112 seats on a undercut portion 114 of a threaded adjusting nut 116, threaded over the flat end of shaft 84 for adjusting the tension forces on the brake members 98—98 against the hub 90. A urethane (plastic) tire 118 disposed in groove 120 in roller hub 90 engages the urethane tire 56 of feed drive wheel 54 forming the previously mentioned "nip" therebetween.

Rotative adjustment of member 116 compresses spring 112 along shaft 84. However, the combination of the sleeve-spacer 108 against the bushing 102 at one end and the fixed stop 106 at the opposite end places the rod 84 in tension moving the shaft 84 slightly compressing the assembly 94-98 and 98-102 against the roller hub 90. In this manner shaft 84 is effectively pulled rightwardly. This adjustment thus varies the contact forces between item drive roller 54 and retard roller 82.

Disposed beneath the leftmost side of the item feed head 10 and adjacent to the adjusting nut 116 is a paper and feed head height sensing switch 122 with its actuator arm 124 FIG. 2 arranged to project upwardly, so as to contact the lower surface of the lower item guide 26. As can be seen, arcuate, upward movement of the feed head 18 (FIG. 1) about pivot point 14 will cause the switch 122 to close or "make" for purposes to be described presently.

Secured to opposite side wall members 16 and 18 at opposite ends of the upper guide 20 are individual L-shaped brackets 134. A vertically depending spring retainer member 136 is secured to each bracket and supports the upper end of compression spring 138. The lower end of each spring 138 is captivated on a vertical dimple 140 in the sheet metal guide 20. Adjusting nuts 142 at the side wall permit the tension on each spring 138 to be increased or decreased as required so as to apply a normal force on each end of the retard roller 82, as will now be explained.

Upper sheet metal member 20 supports the upstanding bearing housings 62 and 68 for cantilever shaft 64 on which drive wheel 54 is rotatable about pivot 14. The lower sheet metal member 26 also pivotable about pivot 14 carries the retard roller 82. Members 134 are attached to lower sheet metal member 26. Springs 138 are retained by the sheet metal spikes or bent over tangs 136 on lower member 26 at their upper ends and at their lower ends by the raised dimples 140 on upper sheet metal member 20. The springs 138 are adjustably tensioned by means of a slot (not shown) and an adjusting nut 142. The pressure of the springs 138 attempts to press the sheet metal member 26 against the feed wheel. Since the retard roller 82 is attached to member 26 the roller 82 contacts the item feed roller 54 with a normal force generated by the two springs 138. The normal force is transmitted through the sheet metal and the retard roller.

Sheet item feeding with the present invention is "on demand", i.e., when called for by the apparatus software with which the present mechanism is operably associated. While the item feeding is performed at a relatively high rate of speed, on the order of 90 sheets per minute, sheets are fed one at a time, intermittently. Intermittent movement of feed wheel 54 is produced by means of the one revolution spring wrapped clutch 76. The single, rotatably movable pawl 145 of clutch 76 is engaged and stopped by the forward end of solenoid clapper 144 biased into engagement with pawl 145 by spring 146 surrounding the plunger 148 of solenoid 150. Signal potential from a source (not shown) is applied to solenoid 150 over leads 152.

Figure 3:
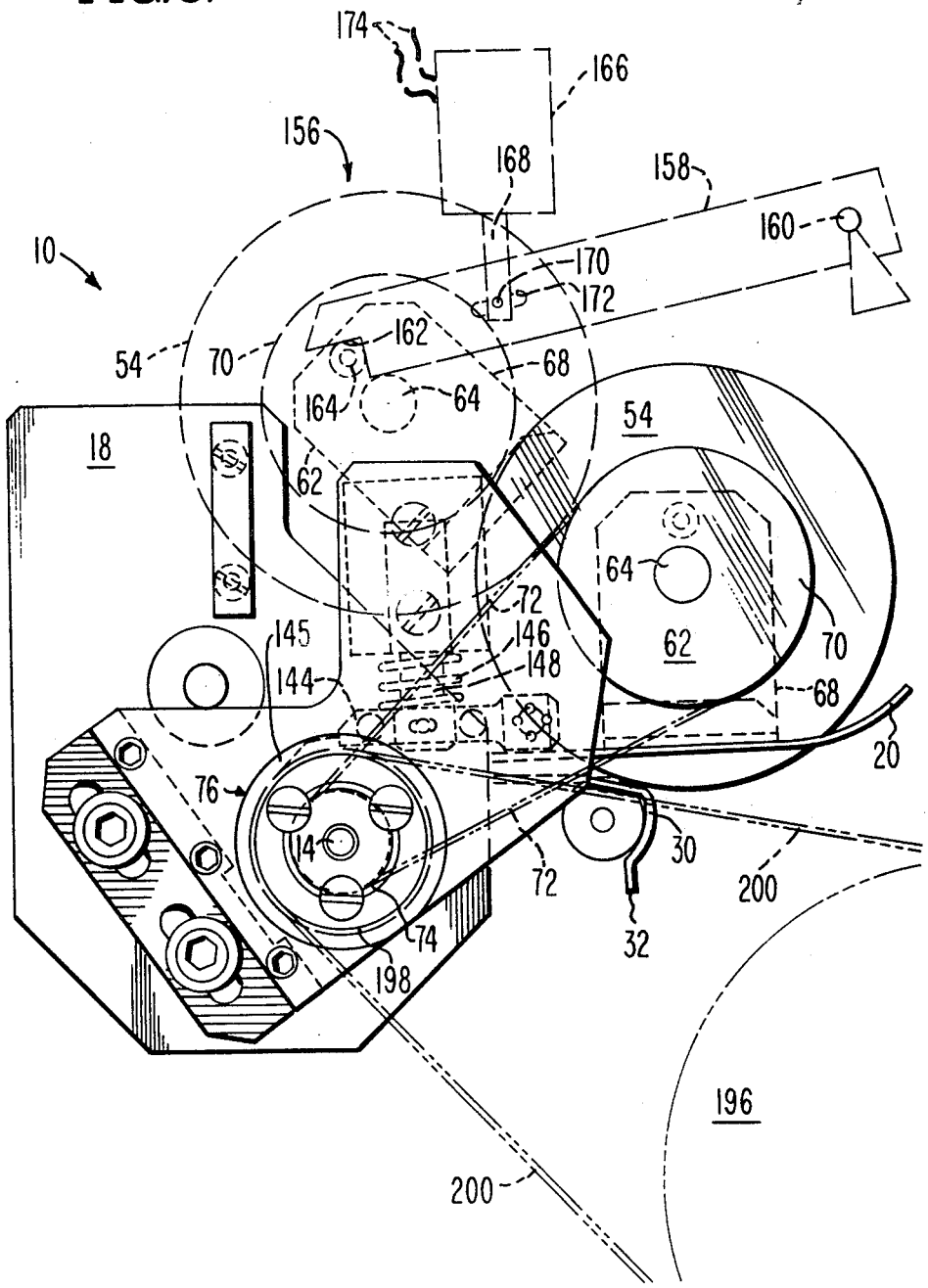
FIG. 3 is a view along the line 3—3 of FIG. 2.
Figures 4, 4A, 4B:
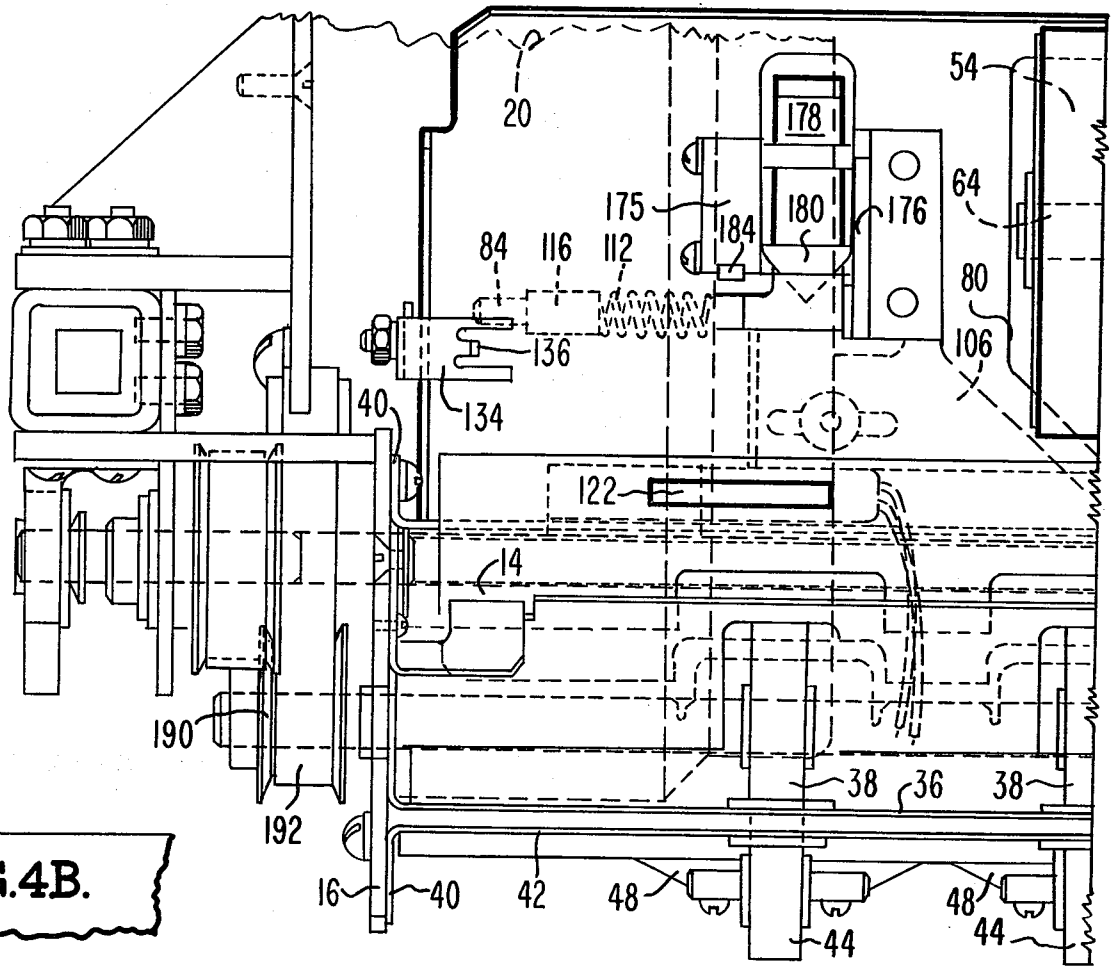
FIG. 4 is a chart of the FIGS. 4-A and 4-B illustrating the proper orientation of these views.
Figure 4B:
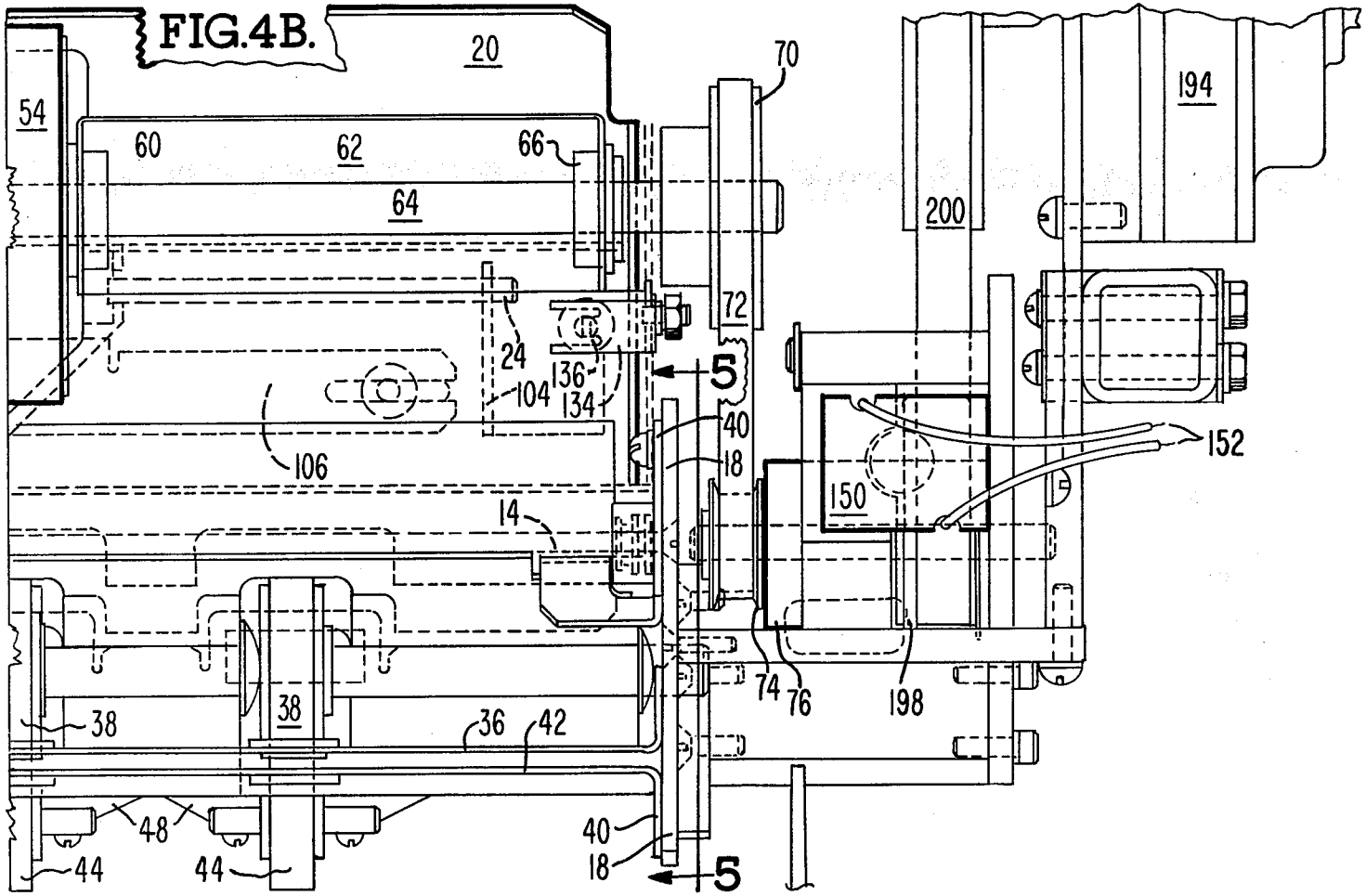
Figure 5:
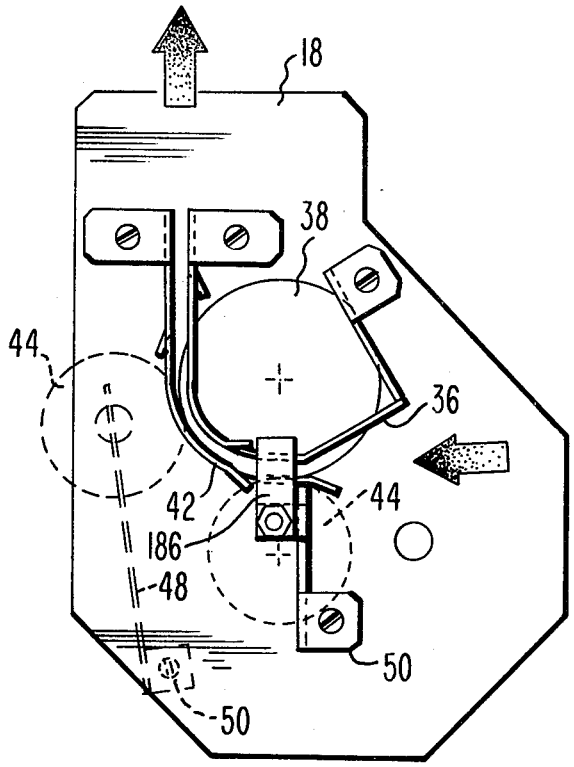
FIG. 5 is a view along the line 5—5 of FIG. 4-B.
Figure 8:
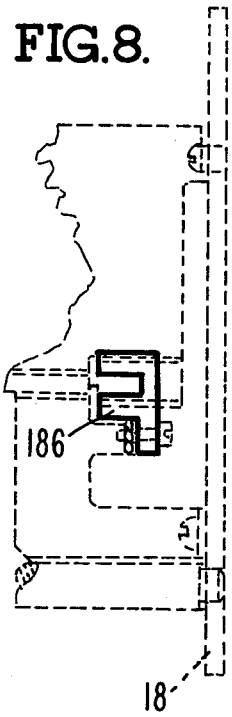
FIG. 8 is an enlarged right end view of the switch apparatus of FIG. 7.
Figure 6:
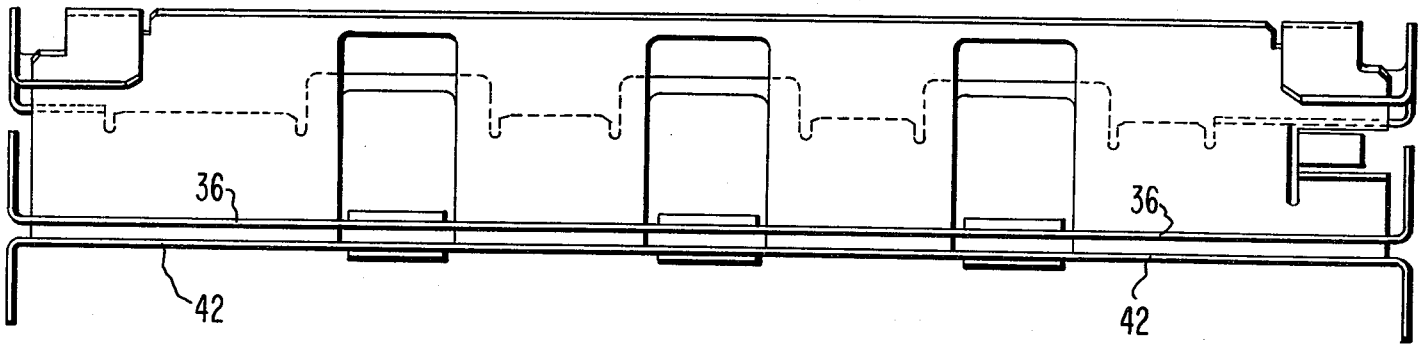
FIG. 6 is a top plan view of paper guides for the apparatus of FIGS. 4-A and 4-B.

As earlier mentioned herein feed head 10 (including upper and lower item guides 20 and 26 and retard roller 82 and associated hardware) is pivotly, arcuately moveable about its pivot shaft 14 from the full line position FIGS. 1 and 3 to the dotted line position. This movement is software controlled through sensing switches strategically located so as to sense the position (i.e., vertical location) of the item feed tray 88 (FIG. 1) as the tray is moved (by means not shown) vertically, upwardly while the sheet items 12 are removed by the feed head and fed into the copying apparatus with which the present mechanism is associated. One such switch is the HALL effect feed head height sensing switch 122 (FIG. 4-A) which indicates the height of the paper feed tray 88 and causes a reload cycle to be initiated.

When empty of paper, continued slight upward movement of the item feed tray 88 pushes the feed head 10 together with operably associated sheet metal members 20 and 26 arcuately, upwardly out of the path of movement of the paper feed tray 88 closing switch 122 halting the upward movement of tray 88 anticipatory to the sheet item reload cycle. As seen in FIGS. 1 and 3 (particularly FIG. 3) a feed head latching mechanism 156 is provided for securing the feed head in an inoperative position out of the path of movement of the item feed tray 88. Mechanism 156 comprises a rockable latching arm 158 which is pivotedly mounted at one end 160 to the frame of the base apparatus. The forward end (leftward in FIG. 3) is provided with a notch 162 engageable in the latched (downward) position with a horizontally extending pin or bolt 164 as seen in FIG. 2, secured, to and projecting from the rightward vertical shaft support 68.

A solenoid 166 has its reciprocably moveable plunger 168 loosely pivoted to latch arm 158 by means of a pin 170 extending into and through horizontal slot 172 therein. Energization of solenoid 166 over/leads 174 causes the engaged latch 158 FIG. 3 to be moved vertically, upwardly to a released position permitting the feed head 10 to move rightwardly, arcuately downwardly from the dotted line position to the full line position ready for an item feeding operation, as will be described later on.

In order to indicate the presence or absence of sheet item material at the "nip" of feed head 10 between the feed wheel 54 and the retard roller 82, an end of paper-item sensing switch 175 is secured to vertical support member 62. The actuator arm 178 of switch 175 is pivotally mounted to the support 176 so that the triangularly shaped leading end 180 thereof is normally disposed in the full line position FIG. 1 with the actuator tang 182 at the opposite end thereof disposed away from the switch plunger 184 and the end of the arm resting on the sheet items. As the stack of items is lowered by removal of paper due to the feeding operation the actuator arm 178 is arcuately moved downwardly. As noted hereinbefore and as seen in the drawing the actuator arm 178 drops between two of the raised lands or projections at the top of the item tray 88 to assume the dotted line position (FIG. 1) causing the actuator tang 182 to engage the plunger 184 and close the contacts (not shown) of switch 175. This action sends a signal to the apparatus software indicating that the machine is "out of paper" or that the feeding apparatus has reached the end of the paper stack.

In order to insure that a sheet item 12 has in fact been fed, a "mis-feed detect" microswitch 186 is disposed adjacent to the downstream driver roller 38 and the turnaround or backup rollers 44—44. This latter switch is a photo-optical type solid state device in which the interruption of a light beam indicates the passage of an item and by suitable timing circuitry (not shown) the detection operation enables the software of the apparatus to signal continued operation.

As mentioned earlier herein the item feeding is intermittent but continuous from the input sheet item hopper, bin or platform tray 88 to the turnaround station including the downstream drive rollers 38 and rollers 44—44. Two separate and independent drive means are utilized to accomplish the high speed item throughput desired. A first continuously rotatable drive motor 188 drives downstream roller pulley 190 through interconnecting drive belt 192. A second continuously rotatable drive motor 194 provided with pulley 196 is rotatably coupled to the clutch drive pulley 198 via belt 200 for continuously rotating this clutch input member 198.

OPERATION

With the reed head 10 in the full line position of FIG. 1 it is noted that the feed drive wheel 54 is resting upon the sheet item stack so that rotation (counter clockwise) of feed item drive wheel 54 will move a sheet 12 rightwardly into the "nip" between wheel 54 and the retard roller 82.

Assuming that the machine is made operational, a signal over leads 152 of solenoid 150 (FIG. 2) will withdraw the pawl 144 from the single tooth 145 of one revolution spring wrapped clutch 76 causing the clutch output pulley 74 to rotate one revolution. This rotative force is transmitted to drive wheel 54 over belt 72 and pulley 70 to rotate drive wheel 54 one revolution effectively passing a single sheet item 12 into and through the "nip" between the roller 54 and the roller 82. As seen most clearly in FIG. 1 the leading edge of the advancing sheet item 12 will be caught by the continuously rotating downstream drive roller 38 and the lower backup roller 44 causing the sheet to move away from roller 54 and into the turnaround formed by the idler rollers 44—44 and the sheet metal guides 36 and 42. The sheet item 12 is thence passed upwardly into the next handling station of the apparatus (not shown).

The present feeding apparatus is designated to permit only a single sheet item to be fed at a time and to prevent and avoid sheet item overlap, multiple sheet item feeds, and/or collision between sheet items being fed. In this regard it is recalled that the large feed wheel 54 in the initial position is resting upon the sheet item stack with a normal force provided by the outboard springs so that rotation of the feed wheel 54 can draw one sheet from the stack. The retard roller 82 is disposed below and slightly inboard from the roller 54 is also spring-loaded against the feed wheel and has an applied frictional torque through the spring 112 so that the only rotation of this member is via the large feed wheel 54. Since feed wheel 54 can only move in one direction due to the one way bearing 78 the sheet items in the normal course are drawn from the stack into the "nip" between the wheel 54 and roller 82.

Three feeding situations immediately present themselves:

1. When there is no sheet item in the "nip" between the feed wheel 54 and the roller 82, the friction between th the two rollers is sufficiently great that as torque is applied to the feed wheel, the retard roller is forced to rotate.

2. When a single sheet time is within the "nip", the formal force transmitted from the feed wheel 54 as torque is applied thereto is sufficient to rotate the retard roller 82 and thus draw a single sheet item through the "nip" for further processing and handling.

3. When two sheets present themselves to the "nip" between roller 54 and roller 82, the feed wheel 54 transmits enough frictional force to the top sheet to drive it forward. On the bottom there is substantially the same coefficient of friction. Since it is required that the coefficient of friction between the two sheets be lower than either the feed wheel 54 or the retard roller 82, the torque transmitted between the two sheets is insufficient to turn the retard roller, thus the feed roller 54 rotates but insufficient force is transmitted through the two sheets, i.e., the interface between the two sheet items, to turn the retard roller. As a result the retard roller 82 stops and remains stationary since the coefficient of friction between the bottom sheet item and the retard roller 82 is higher than the coefficient of friction and the normal forces between the two sheets. The top sheet is thus fed while the bottom sheet remains stationary. This arrangement thus avoids the problems with duplicate feed, collision, and overlap.

Continued feed of sheet items causes the main tray 88 to be elevated vertically to a position where it intercepts the paper tray height sensor switch 122 which signals the software apparatus to stop feeding. Continued movement of the feed tray vertically upwardly moves the feed head 10 arcuately, rightwardly, upwardly until the latch 156 is engaged. At this point the apparatus is in a position in which the operator can add paper after which the item feed tray 88 is lowered permitting the solenoid 166 to disengage the latch lowering the feed head 10 onto the fresh stack of paper for a new or continued sheet item feeding operation.

What is claimed is:

1. Sheet item feeding apparatus for feeding individual sheet items one at a time from a sheet item support member provided with spaced apart item support lands, at high speed, without collision, overlap or multiple item jams comprising:

a single cantilever mounted, relatively narrow, but large diameter item feed member centrally disposed relative to a sheet item feeding pathway, said pathway comprising oppositely disposed, relatively flat, parallel, spaced apart members in and through which said sheet items are fed;

said item feed member having a reasonably high coefficient of friction relative to the sheet items to be fed, a relatively wide sheet item retard member small in diameter relative to said feed member operably associated with said item feed member and in surface contact therewith, the large diameter feed member providing a relatively flat, shallow entering angle of feed for said items between said item feed member and said retard member, oppositely disposed means operably interengaging said oppositely disposed parallel spaced apart members for applying a normal force through said retard member to said feed member relative to said items, means disposed on one of said parallel members movable relative thereto and directly coupled to said retard member for applying a frictional torque force to said rotated member, signal actuated means operably connected to said item feed member for incrementally rotatably moving said member so as to cause a single item to be fed in response to an applied electrical signal, and means mounting said feeding apparatus including said item feed member, said retard member and spaced apart parallel members for pivotal, rockable movement into and out of the item feeding path permitting depleted items to be replenished from a new supply of sheet items.

2. The invention in accordance with claim 1 wherein said means for applying a normal force to said feed member comprises oppositely disposed adjustable spring members arranged to move vertically relative to the axis of rotation of said feed member and said spaced apart parallel members.

3. The invention in accordance with claim 1 further including a signal actuated latch means for latching and restraining said feeding apparatus in an upwardly rotated inactive position effectively disposed out of the path of movement of the item stack, said latch being signal actuatable to permit the feeding apparatus to move arcuately downwardly to engage the items for further feeding in response to an applied signal.

4. The invention in accordance with claim 1 further including means operably associated with said feed member for detecting the absence of sheet items from said sheet item support member provided with item support lands, said means including a microswitch having an elongated actuator and wherein said actuator is arranged to engage said sheet items when said feed member is activated and to drop between said lands for deactivating said feed member when the item support member has terminated its vertical upward travel.

5. The invention in accordance with claim 1 further including means detecting the actual height of the item feed stack said detecting means comprising a microswitch having its actuator arranged to contact the lower one of said parallel, spaced apart members so as to discontinue the continuous incremental feeding of items upon depletion of the items in said stack at the completion of the upward, pivotal movement of said item feed member in response to the incremental vertical movement of the item support member.

* * * * *